US005090170A

United States Patent [19]

Propst

[11] Patent Number: 5,090,170

[45] Date of Patent: Feb. 25, 1992

[54] BUILDING ENCLOSURE SYSTEM

[76] Inventor: Robert L. Propst, 18845 NE. 49th Pl., Redmond, Wash. 98052

[21] Appl. No.: 478,311

[22] Filed: Feb. 12, 1990

Related U.S. Application Data

[63] Continuation-in-part of Ser. No. 208,896, Jun. 17, 1988, Pat. No. 4,899,510.

[51] Int. Cl.[5] ..... E04H 1/00; E04B 2/82

[52] U.S. Cl. ..... 52/243.1; 52/126.3; 52/238.1; 52/241; 52/584; 52/586

[58] Field of Search ..... 52/241, 238.1, 243.1, 52/126.1, 126.3, 126.4, 126.7, 584, 585, 586

[56] References Cited

U.S. PATENT DOCUMENTS 3,189,135 6/1965 Slowinski ..... 52/241

3,603,049 9/1971 Pierce ..... 52/241

*Primary Examiner*—Michael Safavi

*Attorney, Agent, or Firm*—Seed and Berry

[57] ABSTRACT

Clamping units are mounted without fasteners in the joints between wall panels and grip adjoining panels in coplanar alignment. The clamping units are inserted through accessways between the panels and are operated by a tool passed through the accessways. The clamping units are also used to hold upper locking units, each having a slide bolt which engages a ceiling rail, and to hold bottom locking units which engage a bottom rail on which the wall panels are seated. Each panel can be removed independently of the others by tilting after removal of the respective clamping units and associated locking units.

16 Claims, 11 Drawing Sheets

FIG. 1
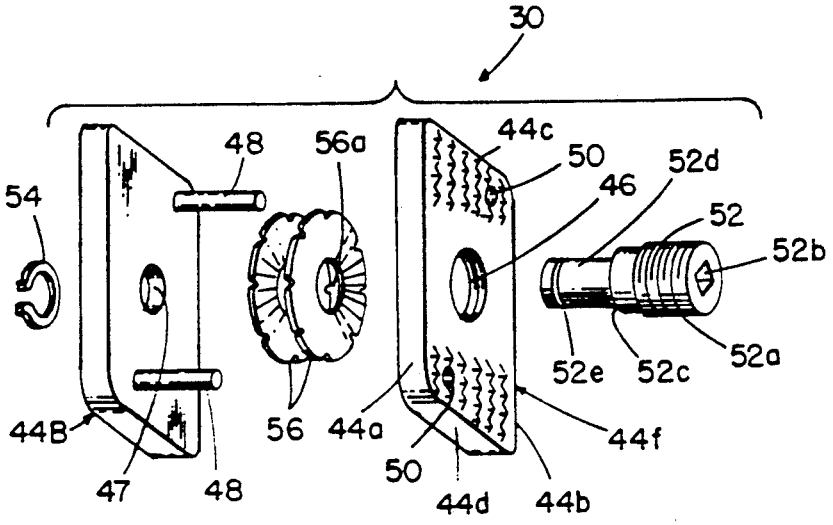
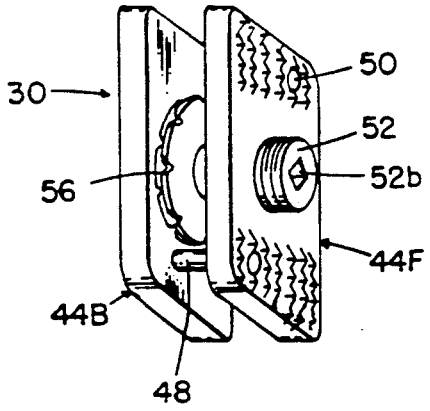
FIG. 2

FIG. 3
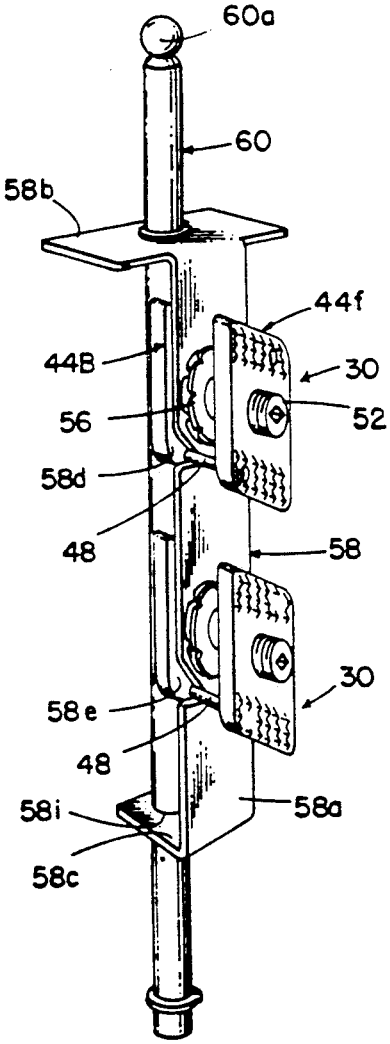
FIG. 5
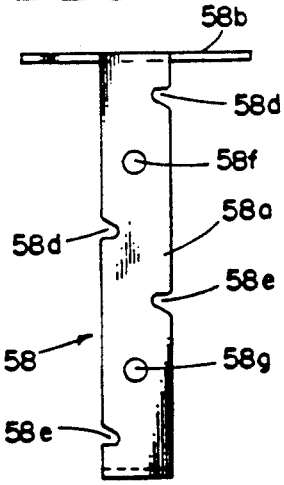
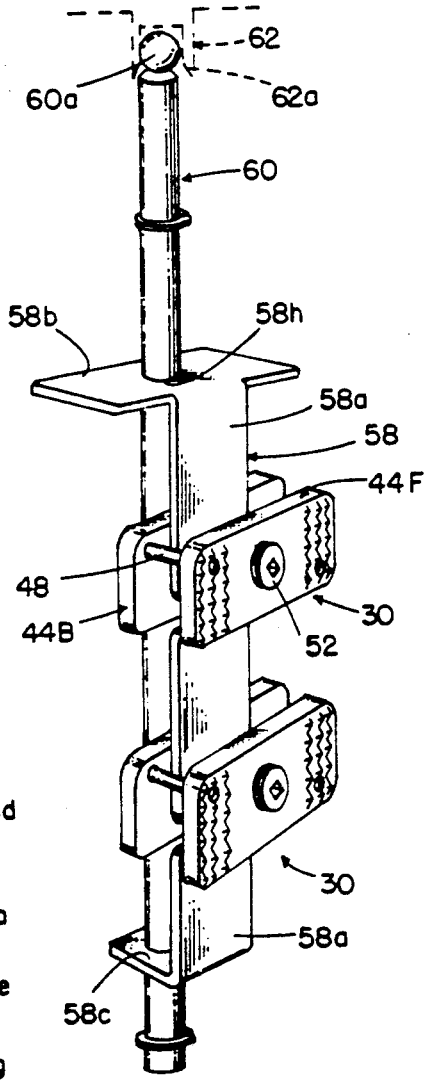
FIG. 4

FIG. 12
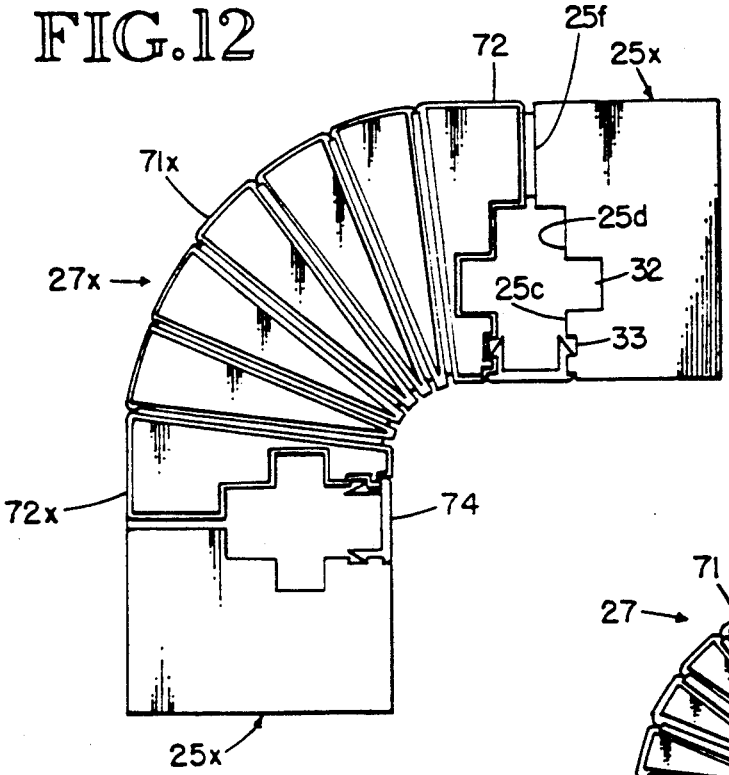
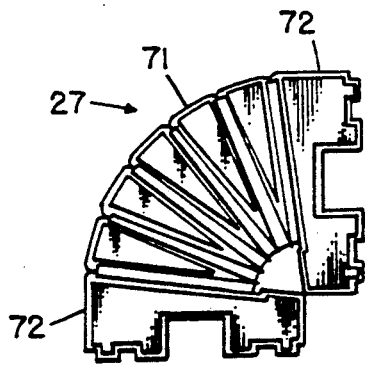
FIG. 13

FIG. 16
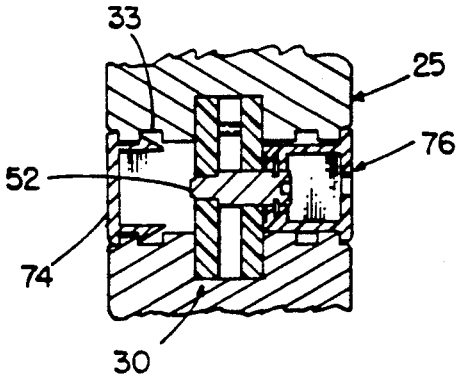
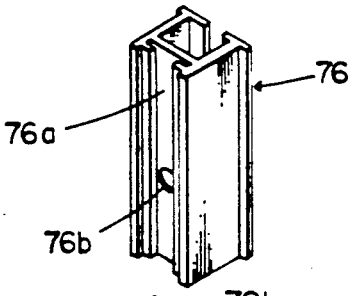
FIG. 14
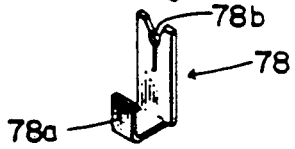
FIG. 15
FIG. 17
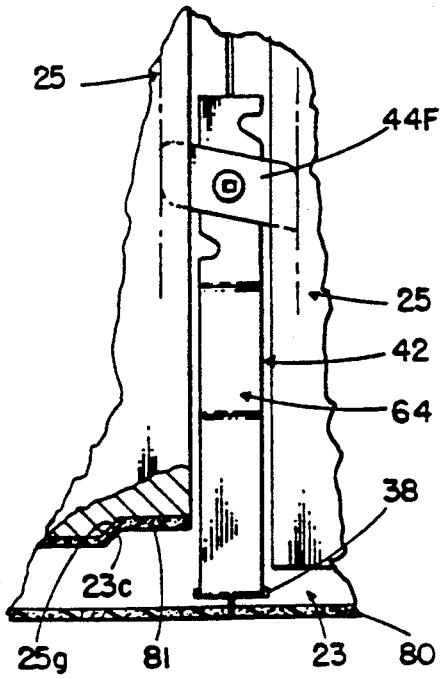

BUILDING ENCLOSURE SYSTEM

CROSS-REFERENCE TO RELATED APPLICATION

This application is a continuation-in-part of my copending allowed application Ser. No. 07/208,896, filed June 17, 1988, now U.S. Pat. No. 4,899,510.

TECHNICAL FIELD

The present invention relates to building systems of the type having interior and exterior non-load-bearing walls formed by modular, prefabricated wall panels which can be moved and substituted on site to vary floor plans and wall details.

BACKGROUND ART

In the past, various systems have been used to connect prefabricated wall panels in place, but they have normally failed to preserve a modular relationship making it possible to assemble the panels exactly in accordance with a preset layout program and they have failed to enable the panels to be easily changed without disturbing adjoining panels. These failures have resulted in large part because the location of each successive panel during the erection process was made dependent upon the position of the previously erected panels, and the hardware interconnecting the panels tended to draw the panels toward one another during installation. Also, normally the hardware was either permanently attached or screw-attached to the wall panels, and if designed to be hidden from view, commonly required special recesses or pockets to be formed in the panels for housing the hardware. Release of the hardware of an intermediate wall panel was either impossible, difficult, or required access to both sides of the panel, or required releasing space and access at the top of the panels.

DISCLOSURE OF THE INVENTION

A significant objective of the present invention is to provide a wall system making it possible to use and interchange precision-molded wall panels without any hardware having to be attached thereto for use, and making it possible to easily release and replace a wall panel without disturbing adjacent panels and without requiring access from the top or to both sides of the panels.

In accordance with the present invention, modular floor rails are provided which accurately define the positions for the lower ends of prefabricated modular wall panels. The wall panels interfit with the floor rails such that they can be tilted into vertical position and be restrained at their lower ends by the interfit against horizontal movement both transverse and longitudinal of the floor rails. While being tilted into vertical position on the floor rails, the upper ends of the wall panels clear ceiling rails which interfit with the heads of slide bolt elements provided by slide bolt units clamped to the wall panels by spreader clamps to restrain the upper ends of the wall panels against transverse movement. The interfit between the heads of the slide bolt elements and the ceiling rails is such as to vertically restrain the slide bolt elements and permit relative vertical movement between the wall panels and the vertically restrained slide bolt elements. As a result, the ceiling can move vertically relative to the wall panels to compensate for any ongoing variances in the space between the top of the wall panels and the ceiling.

The wall panels have channel grooves along their vertical edges, and the spreader clamps firmly engage the side walls of these grooves. Additional spreader clamp units may be applied at other elevations to assist in holding the wall panels in coplanar alignment and are also used near the lower ends of the wall panels to hold anchor hooks which interfit with the floor rails to prevent the wall panels from being vertically displaced.

The exterior wall panels are recessed along their indoors side to provide indoor accessways which extend beyond the channel grooves to an outside lip, whereas the interior wall panels are preferably spaced apart at both sides to provide accessways to the channel grooves at either side of the interior walls. These accessways are used to introduce the slide bolt units, anchor hooks, and spreader clamps after the wall panels are in vertical position, and are then filled with trim strips or hanger strips, or otherwise covered. All of the joints are provided with suitable moisture barriers, insulation and moldings.

The spreader clamp units each have a pair of spreader plates held in alignment by dowels and are caused to move apart by action of a screw element which is threaded through one of the spreader plates and passes freely through the other by way of a nonthreaded stem portion of reduced diameter originating at an annular stop shoulder and having an annular groove adjacent its other end. Spring washers are positioned between the stop shoulder and the nonthreaded spreader plate. The spreader clamp is held in assembled relation by a C-element fitting into the annular groove in the stem portion of the screw. The screw element of the spreader clamps used to mount the slide bolt and anchor hook units also passes through a mounting bracket or plate on the units which is located between the nonthreaded spreader plate and the spring washers and does not restrict clockwise turning of the spreader plates relative to the units.

The spreader plates are shaped to pass through the accessways when held in an entry position and to extend into the channel grooves for the full depth thereof when turned about eighty degrees from the entry position into an operative position. Continued turning of the screw element then causes the spreader plates to move apart and firmly engage the side walls of the channel grooves. This spreading action results in compression of the spring washers. The clamping action of the spreader plates helps to vertically align the wall panels but does not pull the wall panels toward one another or push them apart. Thus the modular relationship of the wall panels established by the floor rails is not disturbed. This makes it possible to remove and substitute wall panels at will, without effecting the positions of the adjoining panels, merely by releasing the spreader clamps and the respective slide bolts and anchor hooks. The compressed spring washers maintain a firm gripping action by the spreader plates under varying conditions such, for example, as thermal changes.

BRIEF DESCRIPTION OF THE DRAWINGS

FIG. 1 is an exploded perspective view of the parts of the spreader clamp unit of the present invention;

FIG. 2 is a perspective view of the spreader clamp after assembly;

FIG. 3 is a perspective view of the ceiling lock assembly with its related spreader claims in position to be moved into operative position between wall panels;

FIG. 4 is a perspective view of the ceiling lock assembly illustrating the spreader clamps moved to clamping position and the slide bolt raised into locking position;

FIG. 5 is a front elevational view of the bracket element of the ceiling lock assembly;

FIG. 12 is a top plan view of an exterior corner unit and related wall panels;

FIG. 13 is a top plan view of an interior corner unit;

FIG. 14 is a fragmentary perspective view of a mounting channel for fitting in the accessway between adjoining panels;

FIG. 15 is a perspective view of a mounting clip for use in conjunction with the mounting channel;

FIG. 16 is a transverse cross-sectional view through the joint between adjoining interior wall panels at the location of a spreader clamp unit associated with a mounting channel and mounting clip;

FIG. 17 is a fragmentary front elevational view, with part of a wall panel broken away, showing the floor locking unit in operative position;

BEST MODE FOR CARRYING OUT THE INVENTION

Figure 6:
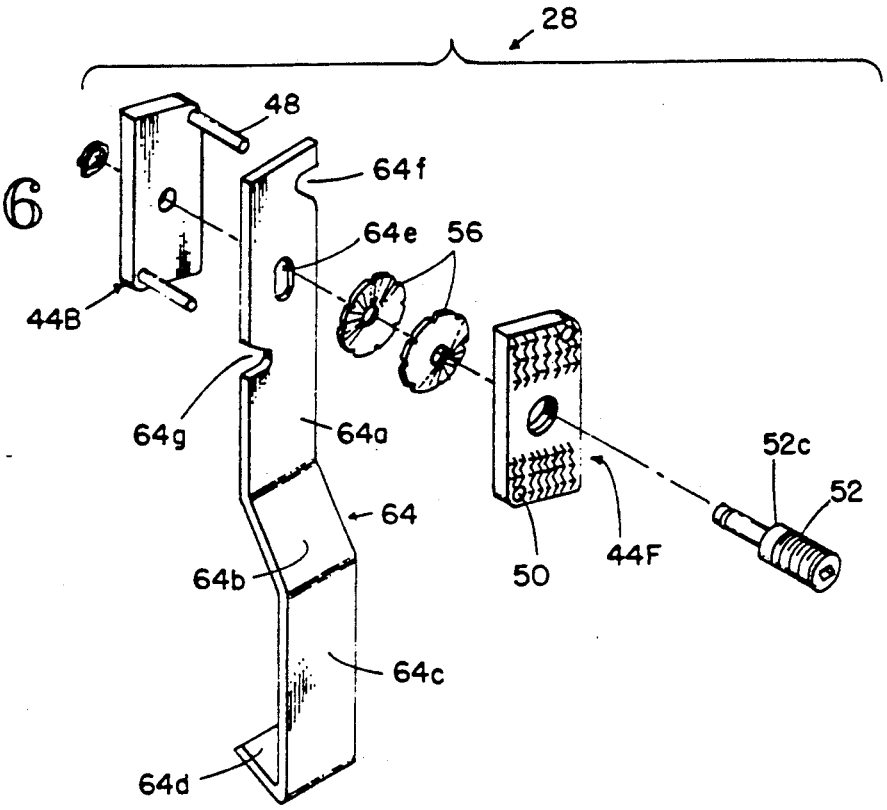
FIG. 6 is an exploded perspective view of the parts of the floor lock assembly.
Figure 7:
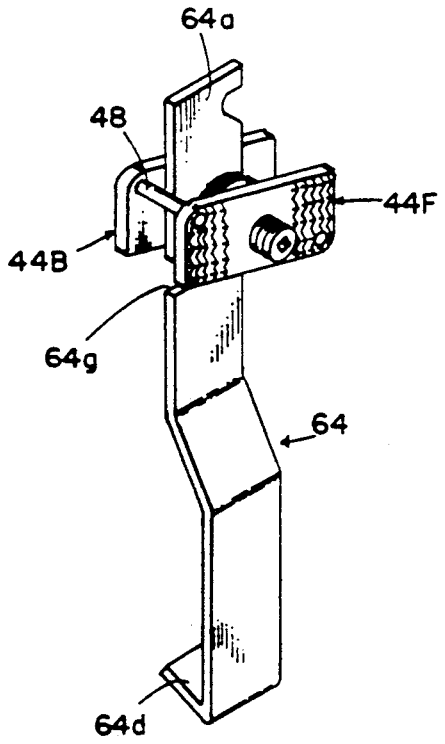
FIG. 7 is a perspective view of the floor lock assembly with its related spreader clamps in position to be moved into operative position between wall panels.
Figure 8:
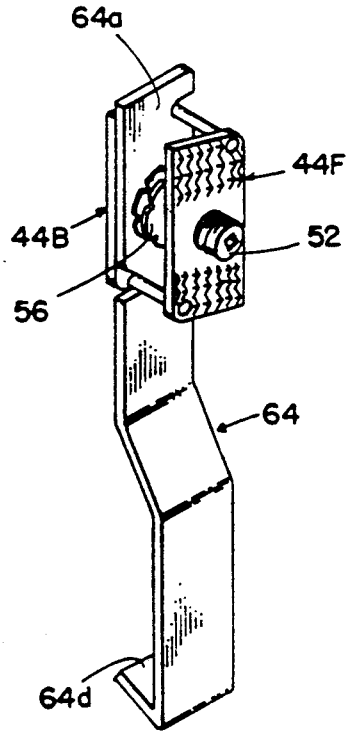
FIG. 8 is a perspective view of the floor lock assembly showing the spreader clamps moved to clamping position.
Figure 9:
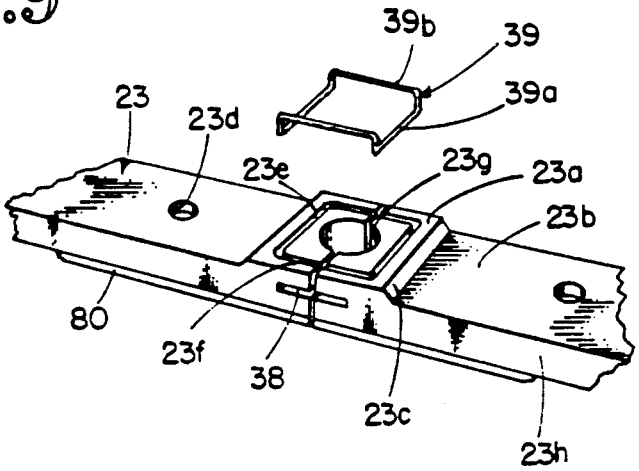
FIG. 9 is an exploded perspective view illustrating two rail sections and the related spring clip ready to be inserted.
Figure 10:
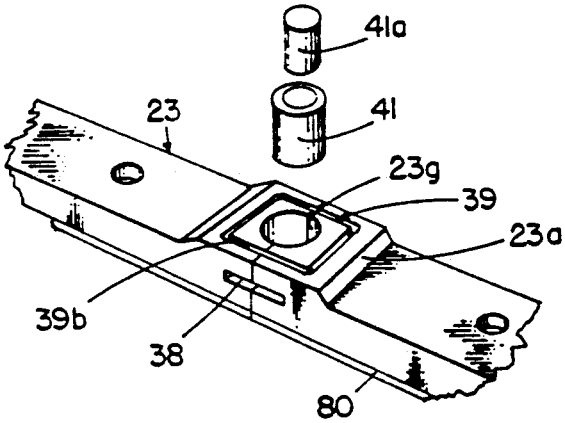
FIG. 10 is an exploded perspective view illustrating two rail sections after insertion of the spring clip and showing the cup gasket and plug ready to be inserted.
Figure 11:
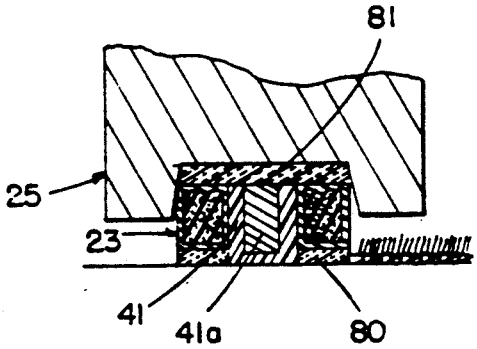
FIG. 11 is a transverse cross-sectional view through the joint between adjoining floor rail sections after installation of the cup gasket and plug.
Figure 18:
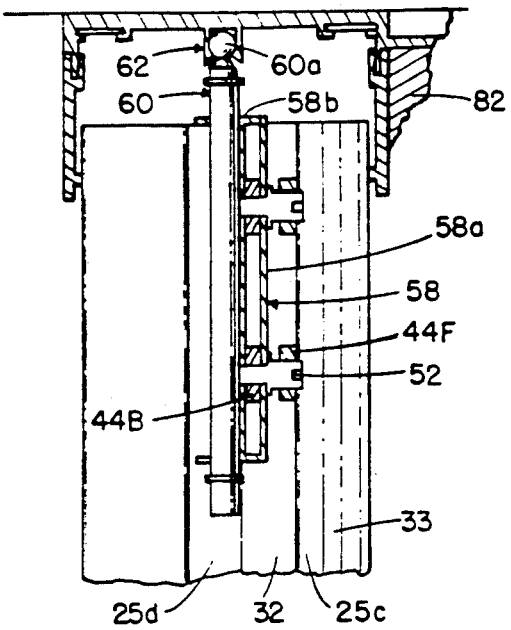
FIG. 18 is a fragmentary vertical sectional view through the joint between adjoining exterior wall panels showing the ceiling lock and floor lock assemblies in operative position.
Figure 19:
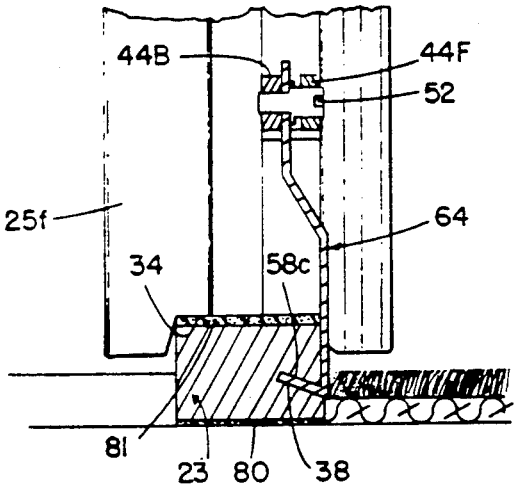
FIG. 19 is a transverse cross-sectional view through the joint between adjoining exterior wall panels and showing a spreader clamp unit in top plan view in clamping position.

The present invention incorporates a ceiling structure 20 having ceiling rails 21, a floor structure 22 having floor rails 23, and nonbearing wall structures including side-by-side panels 25. The ceiling structure 20 is supported in parallel spaced relationship to the floor structure as part of a weather shell structure 24 providing a foundation, roof, roughed-in utilities, and suitable external load-bearing columns **24*a* or narrow wall sections 24*b* which are preferably situated such as to limit only to a minor extent the locations of outside walls, doors and windows and leave the interior floor area unrestricted as to layout. The floor structure 22 may comprise a floor system with removable floor panels mounted on pedestals in a plenum containing wiring, plumbing, and ducts. Similarly, the ceiling structure 20** may comprise a ceiling system with removable ceiling panels giving access to an overhead plenum.

The wall panels 25 interfit with the floor rails 23 and are provided with ceiling lock assemblies 26 engaging the ceiling rails 21, and floor lock assemblies 28 having a hooking engagement with the floor rails 23. The wall panels are preferably used in conjunction with corner units 27. Basic to both the ceiling and floor lock assemblies are panel gripping units 30 which are also used independently as alignment clamps.

Preferably, the wall panels 25 are precision molded by well-known laid-up, twin-sheet or blow-molding techniques resulting in a rigid unit having a durable skin **25*a* enclosing a foam core 25*b* having good insulating and sound-absorbing characteristics. Each panel 25 is formed along each of its two vertical side edges with a channel groove 32 located between coplanar side edge faces 25*c*, 25*d* and is formed along its bottom edge with a positioning groove 34. For panel symmetry, the top edge of the panels may also be grooved. The vertical edge faces 25*c*, 25*d* may be interrupted by vertical keeper grooves 33**.

The panels for exterior walls, designated **25*x*, are preferably thicker than those for interior walls, with the add-on thickness being on the exterior (outdoor facing) side and forming outer lips 25*e* along the vertical edges which have longitudinal edge faces 25*f* and extend for the full height of the panels 25*x*. The floor rails 23*x* and top and bottom positioning grooves 34*x* formed in the exterior walls are preferably wider than the floor rails 23 and grooves 34 for the interior panels 34. Other than width, the exterior and interior floor rails 23, 23*x* may be identical. They each have a generally rectangular, transverse cross section with an upper side formed with end positioning ledges 23*a* which are stepped above the level of an intermediate section 23*b* at sloped retaining shoulders 23*c*. The wall panels are internally recessed at the intersection of the channel grooves 32 and positioning grooves 34 to provide vertical sloped shoulders 25*g* which complement in slope and spacing that of the positioning shoulders 23*c* of the floor rails 23. The total length of each floor rail 23, 23***x* is the same as an established panel module and is maintained during production. In this regard, the horizontal distance between the lip edge faces 25*f* of each exterior panel 25*x* would be made slightly less than the panel module so that there will be a narrow exterior gap 36 between adjoining panels 25*x* for weather stripping.

It is preferred that the floor rails 23, 23*x* be formed with a row of countersunk vertical holes 23*d* to receive nails or screws for attachment to the underlying floor structure. One or both of the side faces 23*h* of the floor rails 23, 23*x* are formed at their ends with horizontal anchor slots 38 to receive the floor lock assemblies 28. The anchor slots 38 preferably slope upwardly within the floor rails. It will be apparent that the floor rails 23, 23*x* may be made to a length equal to multiple of the panel modules, in which case the resulting interior ledges 23*a* would have double width longitudinally of the rails. There is no need for the ceiling rails 21 to be modular in length.

To assist in aligning the floor rails 23 and 23*x* during initial layout on the floor, and allowing a loose initial assembly of all of the floor rail sections to assure location of all elements, the floor rail sections are fastened to the floor unit, the end ledges 23*a* thereof are each provided with a transverse slot 23*e* adjacent the shoulder 23*c* and a pair of shallower longitudinal slots 23*f* extending from the ends of the transverse slot to the respective end of the floor rail section. These slots 23*e*, 23*f* of adjoining floor rail sections are adapted to receive a wire spring clip 39 having depending U-sections 39*a* at its ends joined by tension links 39*b*. The U-sections are shaped to occupy the transverse slots 23*e* at adjoining ends of the two floor rail sections and the tension links 39*b* are located to occupy the related longitudinal slots 23*f*. The spacing of the tranverse slots 23*e* slightly exceeds the length of the tension links 39*b* so that they will be tensioned when the U-sections 39*a* are pressed downwardly into the transverse slots 23*e*.

It will be noted that the ends of the floor rail sections have semicylindrical recesses 23*g* at their ends so that two end-to-end floor rail sections provide a cylindrical pocket for receiving a cup gasket 41. This cup gasket is pressed firmly into sealing relation with the related floor rail sections and underlying weatherstripping by use of a rigid tapered plug 41*a* which is forced downwardly within the cup gasket.

When two of the interior wall panels 25 are properly positioned side-by-side on floor rails 23, the adjoining side edge faces 25*c*–25*c* and 25*d*–25*d* are spaced apart to provide respective accessways 42 at opposite sides of the panels which give access to the corresponding grooves 32. Similarly, when two of the exterior wall panels 25*x* are properly positioned side-by-side on floor rails 23*x*, the adjoining side edge faces 25*c*–25*c* are spaced apart to provide an accessway 42*x* at the indoor side of the panels. The lips 25*c* on the exterior side of the panel 25*x* block the outer end of the space between side edge faces 25*d* of adjoining exterior panels 25*x* so that it functions as an extension 43 of accessway 42*x*.

The panel gripping units 30 include a pair of front and back clamping plates 44F, 44B with outside gripping faces 44*a* which are preferably formed with gripping teeth 44*b* or other suitable gripping elements for engaging and gripping the opposite side faces 32*a*, 32*b* of the vertical panel grooves 32 in the interior or exterior panels. The front plate 44F has a central threaded bore 46 which aligns with a central bore 47 of lesser diameter in the back plate 44B. Alignment means is provided in the form of a pair of diagonally opposite dowels 48 projecting forwardly from the back plate 44B to register with holes 50 through the front plate 44F. Each gripping unit 30 is completed by a screw 52, C-ring 54, and a pair of Belleville spring washers 56.

The screw 52 has a threaded head portion 52*a* formed at its forward end with a flat-sided recess 52*b* for receiving a complementing tool. The opposite end of the screw 52 is preferably also recessed to receive a suitable screw driver. Behind the head portion 52*a*, the screw 52 is stepped at a shoulder 52*c* to a rear stem portion 52*d* which is formed with an annular groove adjacent its rear end for receiving the C-ring 54.

To assemble a gripping unit 30, the screw may be passed rearwardly through the bore 46 in the front plate 44F and screwed into the bore 46 only partway along the length of the threaded portion 52*a*. Then the screw is passed through center openings 56*a* in the spring washers and through the bore 47 in the back plate 44B, while the dowels 48 are registered with the front openings 50. The spring washers 56 are then confined on the stem portion 52*d* between the shoulder 52*e* and the front face of the back plate 44B, and the rear portion of the stem portion projects rearwardly behind the back plate 44B sufficiently to expose the groove 52*c* so that the C-ring 54 can be applied thereto to hold the assembly together Clamping plates 44F, 44B are generally a parallelogram in shape and the width thereof between longitudinal edges 44*a*, 44*b* is less than the width of the accessways 42, 43, whereas the length thereof between end edges 44*c*, 44*d* measured parallel to the longitudinal edges 44*a*, 44*b* exceeds the width of the accessways 42, 43. It will also be noted that the two diagonally opposite apexes 44*e*, 44*f* of the plates 44F, 44B, which are in the lead when the gripping unit 30 is turned clockwise as viewed from the front, are the closer of the four apexes to the center of the plates 44F, 44B and have their noses rounded.

A pair of the clamping units 30 are used as part of each ceiling lock assembly 26 and one of the clamping units is incorporated in each anchoring unit 28. Referring to a ceiling lock assembly, it is seen that it has a mounting bracket 58 and a slide bolt 60. The mounting bracket 58 comprises an elongated vertical plate 58*a* having horizontal top and bottom flanges 58*b*, 58*c* with aligned openings 58*h*, 58*i* for receiving the slide bolt 60. C-rings 59 filling into annular grooves in the slide keep the slide bolt and bracket 58 in assembled relation before and during installation.

The mounting plate 58*a* and bottom flange 58*c* are narrower than the accessways between panels so that they can pass therethrough, and the top flange 58*b* is preferably wider than the mounting plate 58 and accessways so that it can rest on top of adjoining panels. Along its vertical edges, the mounting plate 58 is formed with vertically staggered pairs of notches 58*d*, 58*e*. The mounting plate also has a pair of central openings 58*f*, 58*g* located midway between the two notches of each pair of notches. The spacing and arrangement of the notches 58*d*, 58*e* and openings 58*f* correspond to those of the dowels 48 and central opening 47 in the back plates 44B of the clamping units 30 so that the dowels can occupy the notches when a pair of the clamping units are mounted on the mounting bracket 58, with their screws passing through the bracket openings 58*f*, 58*g* and the mounting plate 58*a* positioned between the back clamping plate 44B and spring washers 56 of each clamping unit. For such an assembly, the spacing between the shoulder 52*d* and annular groove 52*a* of the clamping screws 52 is increased by the thickness of the mounting plate 58*a*. It will be noted that the arrangement of the pairs of notches 58*d*, 58*e* is such that the clamping units can be turned clockwise relative to the mounting bracket 58.

The slide bolt 60 has a spherical head 60*a* adapted to have a snap interfit with a central locking channel 62 extending along the ceiling rail and having opposed bottom gripping lips 62*a*. As an alternative, the head of the slide bolt can be given a cross section similar to that of the locking channel 62, and the locking channel can be given a suitable cross section similar to that of the head 60*a*. The interfit between the head of each slide bolt and the related ceiling rail holds the slide bolts against vertical movement relative to the ceiling and leaves the ceiling structure and slide bolts free to float relative to the wall panels by way of the sliding fit between the slide bolts and the brackets 58. This compensates for any ongoing variances in the space between the top of the wall panels and the ceiling.

Referring to the floor lock assemblies 28, each has a hook plate 64 formed with an upper vertical mounting section 64*a*, a forwardly sloped central section 64*b*, a front vertical section 64*c*, and a bottom, upwardly sloping, terminal hook section 64*d* adapted to fit into adjoining anchor slots 38 of floor rail sections 23. The upper mounting section 64*a* is formed with a central slot 64*e* and notches 64*f*, 64*g* in its opposite edges. The hook plate 64 receives one of the clamping units 30, with the screw passing through the slot 64*e* and the mounting section 64*a* located between the back clamping plate 44B and the spring washers 56. The dowels 48 of the clamping unit occupy the notches 64*f*, 64*g* when the length of the clamping plates 44F, 44B is aligned with the length of the hook plate 64. The arrangement of the notches permits the clamping plates to then be turned clockwise relative to the hook plate. Thus, a floor lock assembly 28 can be inserted through the accessway between two adjoining wall panels and the hook 64*d* fitted into the anchor slots 38 of the underlying floor rail sections preparatory to locking the clamping unit 30 of the floor lock assembly in place by turning its screw 52.

Figure 21:
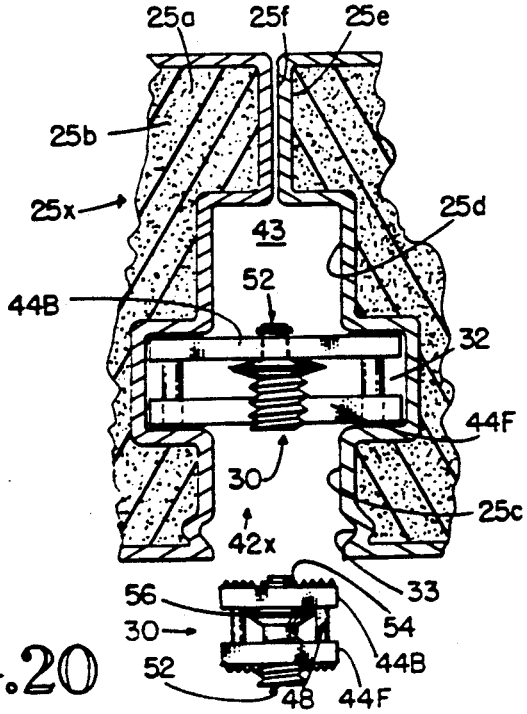
FIG. 21 is a front elevational view of a spreader clamp unit as in FIG. 19 when turned into clamping position.
Figure 20:
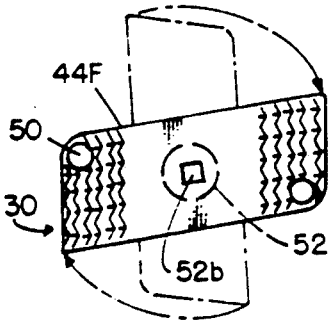
FIG. 20 is a top plan view of a spreader clamp unit in position to be inserted through the accessway between wall panels.
Figure 22:
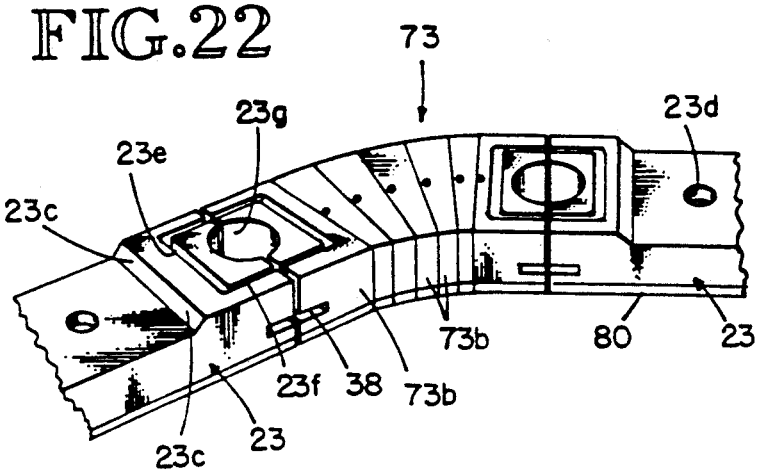
FIG. 22 is a perspective view showing a corner floor rail section in mounted position between two straight rail sections.
Figure 23:
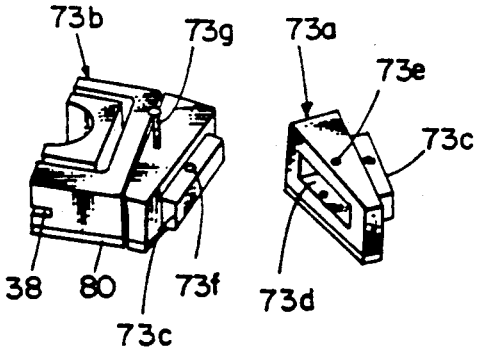
FIG. 23 is an exploded perspective view of parts of the curved corner rail section.
Figure 24:
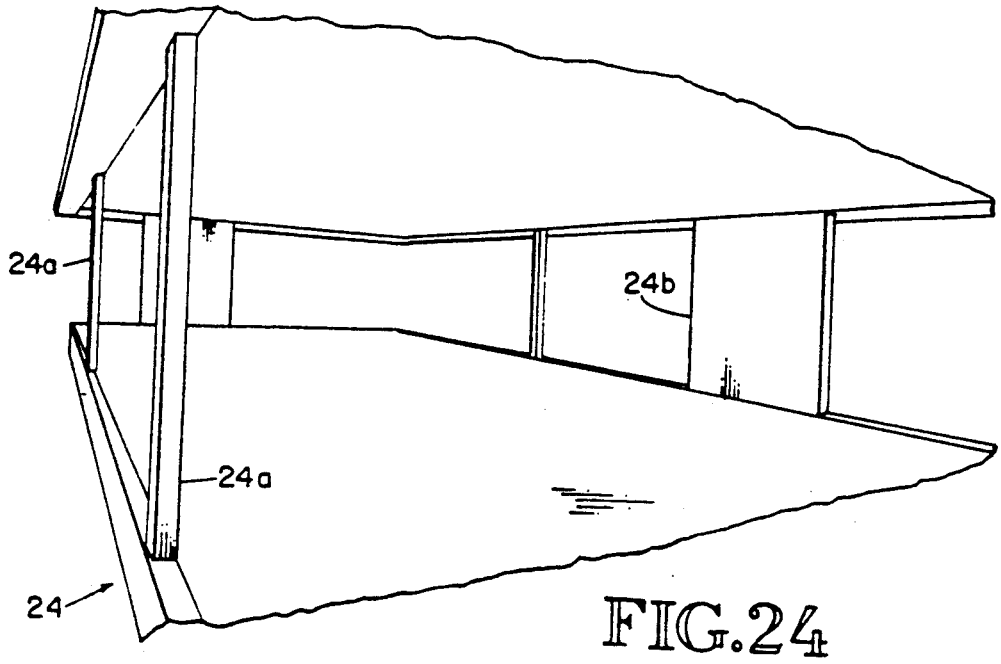
FIG. 24 is a fragmentary perspective view illustrating a typical weather shell for use with the present invention.
Figure 25:
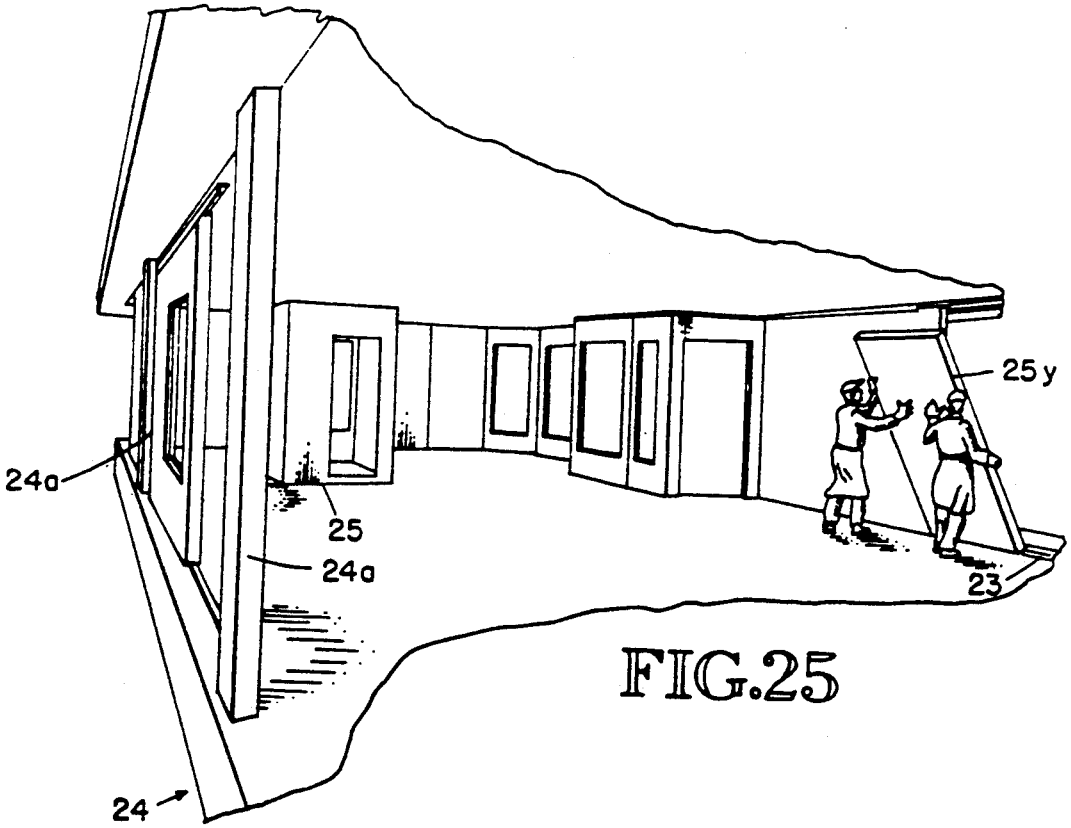
FIG. 25 is a fragmentary perspective view corresponding to FIG. 23 after installation of wall panels and showing a wall panel being tilted up into position.
Figure 26:
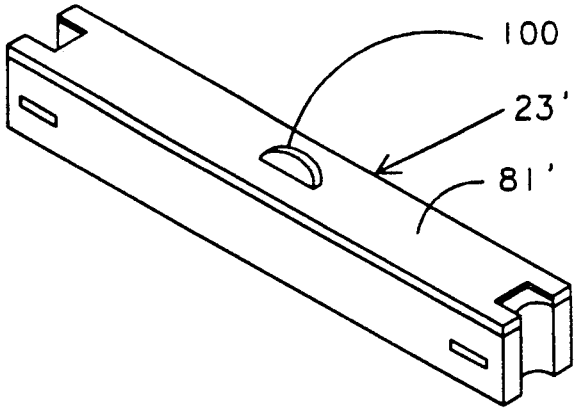
FIG. 26 is a perspective view of a modified floor rail section for use in an alternative building enclosure system.
Figure 27:
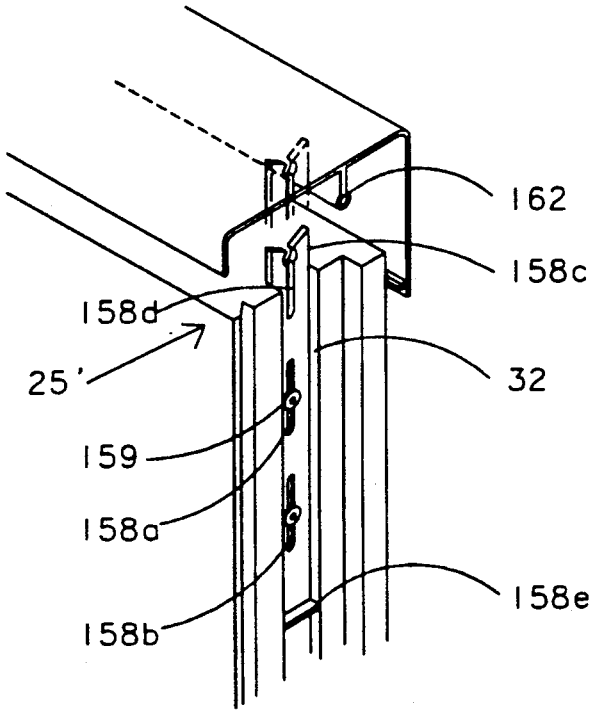
FIG. 27 is a detail perspective view showing a modified ceiling attachment arrangement for use in the modified system.

As part of the present invention, it is preferred to provide at the exterior corners of the building structure non-load-bearing interior and exterior corner units 27, 27*x* comprising molded intermediate sectors 71 and end sections 72 connected together at weatherproof joints. The end sectors have their outer longitudinal end walls formed to the same configuration as the vertical side edges of the wall panels 25 so that the panels adjoining the corner units can be secured to the corner post by clamping units 30 and to the floor and ceiling rails by ceiling and floor lock assemblies 26, 28 at the joints between the corner post units and the adjoining wall panels. The number of intermediate sectors 71 can be varied to vary the corner angle. The corner units 27, 27*x* are basically the same except that in the case of the interior corners, the longitudinal end walls will be narrower to match in size and configuration the vertical side edges of the interior wall panels 25. It is preferred to provide curved floor rail sections 73 (FIG. 21) to fit between the ends of the straight floor rail sections 23 adjoining the corners and to provide the lower ends of the corner units 27, 27*x* with grooves to interfit with these corner curved floor rail sections 73 in the same manner as the wall panels interfit with the other floor rail sections 23. The curved floor rail sections 73 may be molded as a single piece or may comprise multiple intermediate segments 73*a* fitting between end pieces 73*b*. Each intermediate segment 73*a* encompasses an angle module, such as, for example, 7½ or 15 degrees, so that multiple of the segments can be selected to form the desired corner angle. The segments 73*a* each present a tongue 73*c* at one side and a matching socket 73*d* at the opposite side for interfitting the segments. Alternate of the pieces 73*b* are formed at their inner end with a tongue 73*c* or socket 73*d* to interfit with the selected intermediate segments 73*a*. Mating vertical holes 73*e*, 73*f* are provided for passing nails 73*g* through the tongues 73*c* and into the underlying floor structure.

Referring to FIGS. 14–16, the accessways between the wall panels may be covered by trim strips 74, which have longitudinal feet 74*a* which snap-fit into the grooves 33. The accessways can also house mounting channels 76 for holding shelf or cabinet brackets, for example. Each mounting channel 76 has a back T-slot 76*a* for slidably receiving clips 78, having a handle 78*a* at one end and an opening 78*b* at its other end for fitting over the screw 52 of one of the clamping units 30. The back wall of the mounting channel 76 is formed with openings 76*b* for receiving the head end portion of the screw 52 of clamps 30. With this arrangement, a mounting channel 76 can be connected by clips 78 to two or more clamping units 30, and then the mounting channel 76, clips 78 and clamping units 30 can be inserted as a unit into one of the accessways while the clamping units have the longer dimension of their clamping plates 44F, 44B extending vertically. Then the clamping units 30 can be turned and engaged with the wall panels in the same manner as previously described by turning the screws 52, which are accessible through the front of the mounting channel.

Suitable weatherstripping gaskets 80, 81 are placed between the floor rail sections 25, 73 and the underlying floor structure and between the bottom edge of the wall panels 25 and the top of the floor rail sections Also, suitable moisture-resistant insulation is placed between the tops of the external wall panels 25*x* and the ceiling rails, and in the extensions 43 of the accessways 42*x* of the exterior wall panels. Gaskets may also be placed between the opposed joint faces 25*f* of adjoining exterior wall panels.

Preliminary to installing walls according to the invention, the layout for the floor rail sections 23, 73 is planned and marked, and preferably is computer justified. The installation steps are then as follows:

1. The floor rail sections 23, 73 are located on the floor with bottom weatherstripping 80 in place and are connected together by way of the spring clips 39, following which the floor rail sections are fastened to the floor structure.
2. The ceiling rail is located and installed using a plumb-bob to the floor rail and corner members
3. The weatherstripping cup members 41 and gasket strips 81 are applied.
4. The wall panels 2S, 25*x* are tilted up in place using the floor rails as jig guides.
5. The ceiling lock assemblies 26 are installed.
6. Joint insulation is installed between the wall panels.
7. Clamp units 30 are applied at one or more mid-panel locations.
8. The floor lock assemblies 28 are installed.
9. Panel-to-ceiling insulation is inserted.

10. Face trim is installed between the panels.

11. Ceiling trim 82 is installed.

To later remove a wall panel for substitution, for example, of another panel containing a window, it is only necessary to remove the face trim to gain access to the ceiling lock assemblies 26, floor lock assemblies 28, and intermediate clamp units 30. In each instance, the screws 52 are unscrewed sufficiently to loosen the clamping plates 44*f*, 44*b* and turn them into vertical position for removal through the accessways 42, 42*x* after the slide bolts 60 have been lowered free of the ceiling rail and the anchor hook elements 64*d* have been loosened from the floor rail slots 38. The wall panel is then free to be tilted out of vertical position and removed without disturbing the adjoining panels.

It will be apparent that entire walls can be easily removed and relocated by removing the wall panels as above described, relocating the related floor rail and ceiling rail sections, and reinstalling the wall panels. Depending upon the change in floor plan, additional wall panels and floor rail and ceiling rail sections may, of course, be required.

Another form of the building enclosure system thus far described is illustrated in FIGS. 26–31. A modified floor rail 23, is used having a center rounded pivot boss 100 which projects upwardly from a flat upper surface through an opening in a gasket 81, This gasket has end cutouts at its ends to reveal the keeper slots 23*e*, 23*f* used with clips 39 as before. The bottom edge of the wall panels 25, has arcuate detent 100*a* for receiving the pivot boss 100. This detent is formed at the top and center of the groove extending along the bottom of the wall panel.

Instead of using the upper slide bolt units 58, the modified system includes a flat ceiling attachment member 158 sized to fit into the panel grooves 32. This member 58 has a pair of longitudinal slots 158*a*, 158*b* for receiving a pair of shoulder-type screws 159 passing into the respective wall panel and each having shoulder seating against the wall panels in adequately spaced relation to the screw heads so that the members 158 are free to slide along the panel grooves 32.

At their upper ends, the ceiling attachment members 158 are longitudinally slotted to form a pair of locking jaws 158*c* which are arcuately recessed to provide opposed keeper edges 158*d*. The ceiling rail is modified to provide a central longitudinal rib 162 which is enlarged along its bottom edge portion so as to be shaped to be gripped between the keeper edges 158 c of the ceiling attachment member 158. Preferably, the jaws 158*a* provide a tapered entry for the rib 162 which reduces such that the jaws 158*a* spring apart slightly before the rib 162 can occupy the space between the keeper edges 158*d*. At their lower end the ceiling attachment members 158 have a bottom foot 158*e* extending horizontally at right angles to the main body of the members 158 so that the members 158 can be manipulated up or down by a tool inserted through the accessways 42*x*.

Figure 28:
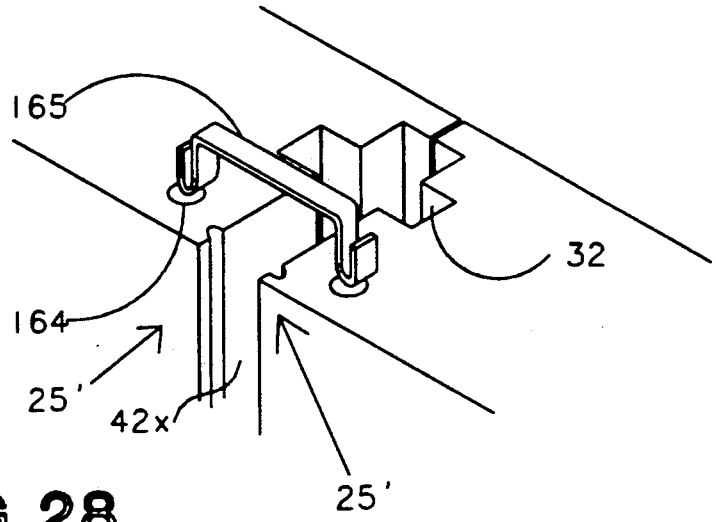
FIG. 28 is a detail perspective view showing a separator clip in position for installation in the modified system.

Referring to FIG. 28, it will be noted that the upper ends of the wall panels are preferably provided with holes 164 for receiving U-shaped separator clips 165 when opposed panels 25' are properly positioned.

Figure 29:
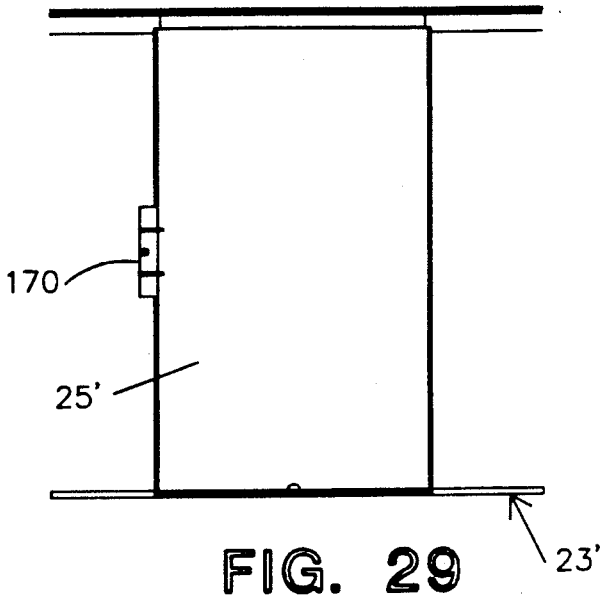
FIGS. 29 and 30 are elevational views illustrating installation of consecutive wall panels in the modified system.

In using the modified system, first the floor rails 23' are assembled for a particular enclosure as before using the spring clips 39. Then the floor rails are fastened down to the floor structure by screws passing through pre-bored holes in the rails. the first wall panel is then positioned on a floor rail with the detent 100*a* registered with the pivot boss 100, and a level indicating instrument 170 is taped on an upright edge of the panel as indicated in FIG. 29. The first panel is adjusted until the level 170 indicates that the panel is vertical, whereupon the ceiling attachment member 158 is moved upwardly into locking engagement with the ceiling rail rib 162.

Figure 30:
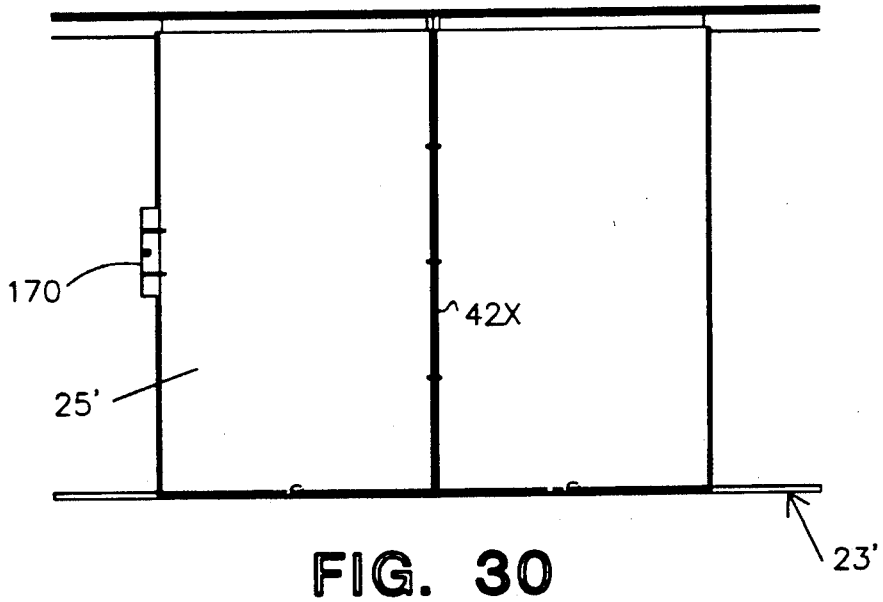
Figure 31:
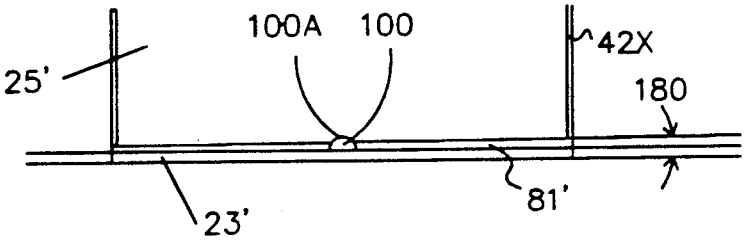
FIG. 31 is a fragmentary elevational view showing, to an exaggerated extent, rocking adjustment of a wall panel on its center pivot in the modified system

Referring to FIG. 30, a second wall panel is then placed in position on the pivot boss 100 of the next floor rail section, and a separator clip 163 is installed to keep the upper ends of the first two wall panels in proper relative position. The level is monitored to make sure the first panel is still vertical at its longitudinal edges. Connectors 30 are then installed between the first and second panels as before to lock the panels together with exactly controlled separation. The described procedures is repeated to erect the remaining panels. The the floor lock assemblies 28 are installed as before. Preferably, each panel 25' is provided with a ceiling attachment member 158 at both of its vertical edges. When each wall pane 125' is initially positioned with its bottom detent 100*a* on the underlying pivot boss 100, the resilient gasket 81' is compressed between the bottom edge of the wall panel and the floor rail 23' before the portion of the wall panel defining the detent 100*a* engages the pivot boss 100. In other words, the gasket 81' is preloaded so that all of the weight of the panel is not taken by the pivot boss 100. As illustrated in FIG. 31, if a floor rail section is not exactly level because of irregularities in the underlying floor structure to which the floor rail section is anchored, the respective wall panel 25' can be rocked on the pivot boss 100 to the extent required to level the bottom edge of the panel. If the wall panel must be rocked to the left, for example, to level its bottom edge, the portion of the compressed gasket 23' between the panel and the floor rail to the left of the pivot boss 100 will be further compressed. At the same time, the compression on the portion of the compressed gasket between the wall panel and the underlying floor rail section to the right of the pivot boss 100 will be correspondingly decreased. The result will be to form an angle 180 between the length of the floor rail section and the bottom end of the panel 25' as indicated in FIG. 31.

When one of the wall panels 25' is to be removed, the floor lock assemblies 28 and the connectors 30 at the vertical edges of the panel are removed as before. The ceiling attachment members 158 for the panel are then released from the ceiling rail rib 162 by applying downward pressure on the respective leg 158*e* and the separator clips 165 for the panel are removed. Then the panel 25, is free to be tilted from beneath the ceiling rail and lifted upwardly free of the floor rail. This panel removal operation can be accomplished without disturbing the adjoining wall panels.

Although the foregoing invention has been described, in part, by way of illustration for the purposes of clarity and understanding, it will be apparent that certain changes or modifications will be practiced without deviating from the spirit and scope of the invention.

I claim:

1. A building structure comprising:

a floor structure;

a ceiling structure;

a support structure between the floor structure and ceiling structure for supporting the latter;

a wall structure between the ceiling structure and the floor structure which does not support the ceiling structure, said wall structure including a row of side edge-by-side edge wall panels, each of said panels being spaced by a gap beneath said ceiling structure and interfitting with the floor structure by way of a respective pivot element projecting upwardly from the floor structure into a concave seat at the bottom of the panel so that the panel is removable when tilted from a vertical position, the interfit between said panels and floor structure preventing movement of said panels along said row;

slide means slidably mounted on each of said wall panels between adjacent said wall panels for interfitting with said ceiling structure to individually hold said panels in vertical position when the wall panels interfit with said floor structure, said slide means each being entirely located within the confines of a respective wall panels;

panel gripping means operably between adjacent said wall panels when engaged for holding the wall panels against movement relative to one another, said wall panels having accessways therebetween to said slide means and panel gripping means for operation thereof;

said panel gripping means being adapted to be moved through said accessways and to be engaged and disengaged by a tool inserted through said accessways, and said slide means also being adapted to be engaged and operated by a tool inserted through said accessways, whereby each of said wall panels may be individually installed and removed without moving adjacent wall panels.

2. A building structure according to claim 1 in which an anchor foot interfits with said floor structure at each wall panel carried by a respective one of said panel gripping means.

3. A building structure according to claim 1 in which resilient gaskets are compressed between said panels and said floor structure.

4. A building structure according to claim 1 in which said pivot elements are presented by floor rail sections comprising part of said floor structure.

5. A building structure according to claim 1 in which a ceiling rail presenting a depending rib comprises part of said ceiling structure, said slide means being adapted to grip said rib.

6. A building structure according to claim 5 in which each of said slide means has a generally horizontally extending foot adapted to be engaged by a tool inserted through said accessway for moving the slide means up and down.

7. A building structure according to claim 1 in which complementing pivot elements and concave seats are provided by said wall panels and floor structure for preventing movement of the lower end of said panels along said row.

8. A wall structure in a building having a floor structure and a complementing ceiling structure, said wall structure comprising:

a floor rail assembly mounted on the floor structure and presenting a row of evenly spaced upright pivot elements;

a row of wall panels centrally seated on respective of said pivot elements and restricted by the pivot elements against movement lengthwise of the floor rail assembly;

a ceiling rail mounted on the ceiling structure above said wall panels;

slide elements mounted between said wall panels and engaging said ceiling rail for restricting lateral movement of the wall panels;

anchor elements mounted between said wall panels and interfitting with said floor rail assembly for restricting vertical movement of said wall panels; and mounting means between said wall panels gripping said wall panels at locations only between said wall panels, said wall panels providing accessways for access to said slide elements, mounting means and anchor elements.

9. A wall structure according to claim 8 in which all of said mounting means can be installed and removed through said accessways.

10. A wall structure according to claim 8 in which said wall panels have opposed recesses with matching recess faces intersecting said accessways, and said mounting means are each adapted to grip said matching recess faces and thereby grip the wall panels.

11. A wall structure according to claim 10 in which said mounting means are adapted to pass through said accessways when in a non-clamping mode and to be bodily turned from said accessways into said recesses for activation into a clamping mode.

12. A wall structure according to claim 8 in which said floor rail assembly has an upper resilient gasket compressed by said wall panels.

13. A wall structure according to claim 8 in which each of said wall panels has a bottom detent receiving respective one of said pivot elements.

14. A wall structure in a building having a floor structure and a complementing ceiling structure, said wall structure comprising:

a row of modular floor rail sections positioned end-to-end on the floor structure, each of said floor rail sections having a raised pivot element at the center of its length;

fasteners anchoring said floor rail sections to the floor structure;

a row of wall panels each centrally seated for restricted rocking adjustment on the pivot element of a respective floor rail section in straddling relation thereto, said panels being restricted by said pivot elements against movement lengthwise of the floor rail sections;

ceiling engaging means mounted between said panels for engaging said ceiling structure to resist rocking movement and lateral movement of the panels; and mounting means between said panels gripping said wall panels at locations between said panels for holding said panels in coplanar relation.

15. A wall structure according to claim 14 in which each of said rail sections has a top resilient gasket compressed by the respective overlying wall panel.

16. A wall structure according to claim 14 in which generally U-shaped separator clips are mounted in holes at the top of adjoining said wall panels.

* * * * *